United States Patent [19]

Boyer et al.

[11] Patent Number: 4,795,480

[45] Date of Patent: Jan. 3, 1989

[54] PAPERMAKERS FELT WITH A RESIN MATRIX SURFACE

[75] Inventors: Donald R. Boyer, Cowansville, Canada; Robert L. Crook, Starkville, Miss.

[73] Assignee: Albany International Corp., Menands, N.Y.

[21] Appl. No.: 939,868

[22] Filed: Dec. 10, 1986

[51] Int. Cl.[4] ..... B24B 1/00

[52] U.S. Cl. ..... 51/296; 428/280; 428/282

[58] Field of Search ..... 428/280, 225, 246, 262, 428/282, 297, 298, 233, 234; 156/153, 154; 51/296

[56] References Cited

U.S. PATENT DOCUMENTS

| | | | |
|---|---|---|---|
| 4,446,187 | 5/1984 | Eklund | 428/234 |
| 4,529,643 | 7/1985 | Lundstrom | 428/280 |
| 4,657,806 | 4/1987 | Dutt | 428/282 |

*Primary Examiner*—James J. Bell

*Attorney, Agent, or Firm*—Kane, Dalsimer, Sullivan, Kurucz, Levy, Eisele & Richard

[57] ABSTRACT

A press felt base (single or multiple layer) having a plastic, fiber reinforced resinous matrix surface, wherein the surface is composed of a resin. The press felt base also having textile fibers distributed throughout the resin and having open air channels and voids throughout the resin once it is hardened.

2 Claims, 1 Drawing Sheet

PAPERMAKERS FELT WITH A RESIN MATRIX SURFACE

BACKGROUND OF THE INVENTION

Field of the Invention

This invention pertains to fabrics used in the papermaking industry. More particularly it relates to felts used in the wet section of a papermaking machine.

During the papermaking process, felts are used to dewater the paper web. The felts undergo severe environmental stresses, i.e., changes in temperature, pressure, humidity, etc. Despite these changes, the felts must retain compaction resistance, resiliency, wear resistance, dimensional stability and ability to uniformly distribute pressure. Various felts have been developed to meet these demands, however none have been found to be completely satisfactory.

SUMMARY OF THE INVENTION

The invention consists of an endless woven press felt base having any of the normal numbers of layers, with a plastic, fiber reinforced, resinous matrix surface replacing the normal needle-punched staple fiber surface. The resinous matrix consists of three phases, the first is a resin chosen for a given application. As an example polyurethane is used when workability and resiliency is desired and polyvinyl chloride is used when hardness and compact resistance is desired.

The second phase is a network of textile fibers whose distribution, composition and size is engineered to enhance the mechanical properties of the total matrix. These fibers may be added to the molten resin prior to application onto the woven base, or may be present on the base prior to the application of the resin.

The third phase is open channels and voids throughout the matrix to permit fluid flow. The overall void volume is controlled by fiber reinforcement structure, chemical additions and the method of resin application. After the resin is cured on the base, a separate grinding operation takes place to open sealed voids and channels and to impart a smooth, highly uniform surface to the felt.

An object of the present invention is to provide a felt with superior compaction resistance. The matrix of the present invention will maintain caliper longer when subjected to the successive loading/unloading cycles in a nip press of a papermaking machine.

Another objection of the present invention is to provide a felt with superior resiliency. The present matrix may be formed with resinous materials, such as polyurethane, which have an ability to recover from deformation which is superior to staple fibers. This results in a longer operational life of the felt and a cost savings from a reduced machine downtime associated with felt replacement.

Yet another object of the present invention is to provide a felt with a better resistance to wear. This increased wear resistance arises from superior matrix material and the improved bonding mode. The thermomechanical and chemical adhesion of the present invention is by far better than the fiber entanglement used in the prior art.

Still another object of the present invention is to provide a felt that is easy to keep clean. The resinous materials used in the present invention have an intrinsically low affinity for the contaminants found in the paper machine environment.

An additional object of the present invention is to provide a felt which provides a uniform and complete pressure distribution between the paper web and felt surfaces in the nip. This feature of the present invention results in improved dewatering of the paper sheet.

These and various other advantages and features of novelty which characterize the invention are pointed out with particularity in the claims annexed hereto and forming a part hereof. However for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings in which like reference numerals indicate corresponding parts throughout the several views.

DETAILED DESCRIPTION OF THE PREFERRED EMBODIMENT

Figure 1:
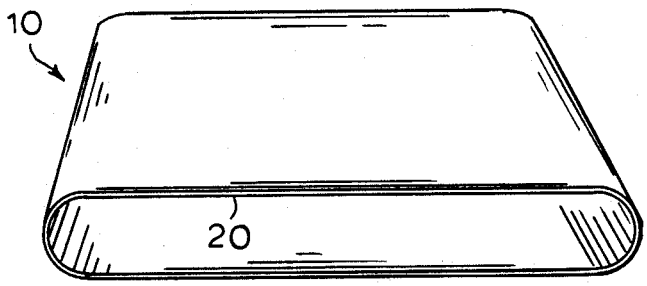
FIG. 1 is a pictorial plan view illustrating a papermakers felt in the form of an endless belt made in accordance with the present invention.

As shown in FIG. 1 the woven press felt 20 is made endless to obtain the papermakers felt 10 of the present invention. The press felt base may be either constructed endless, seamed or joined. The felt 10 may be mounted in the press section of a papermakers machine after being treated as will be described hereinafter.

Figure 2:
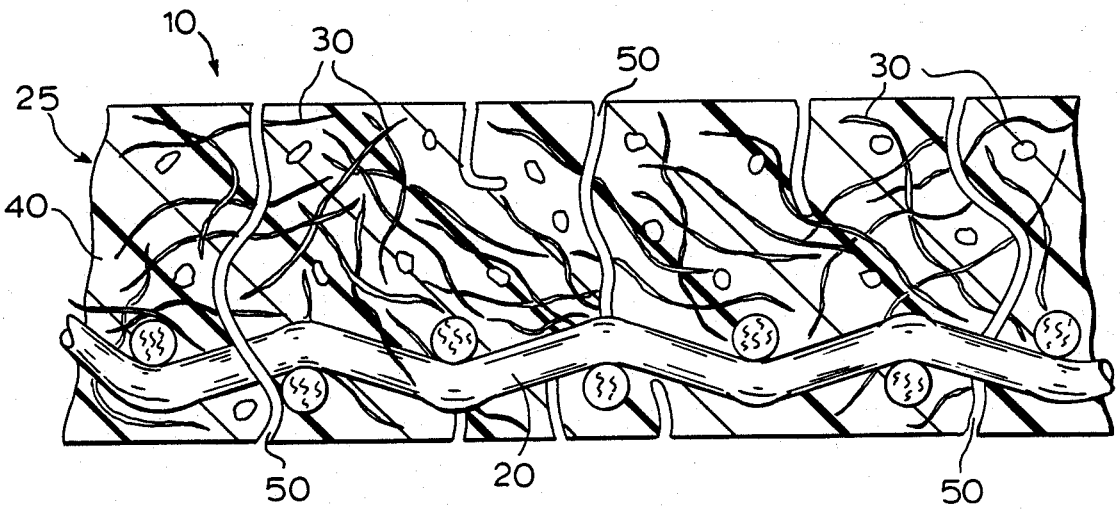
FIG. 2 is a cross-sectional view of the felt of the invention.

FIG. 2 is an enlarged cross-sectional view of the felt 10 shown in FIG. 1 and shows that the woven base 20 having a matrix coating 25 which is comprised of a thermoplastic resin 40, a network of fibers 30 and voids, and open channels 50 throughout the matrix. The voids and channels permit fluid flow in the matrix.

The resin 40 is applied to the woven base 20 by conventional techniques, such as by dipping, spraying and the like of the liquid pre-former of the resin. The method and rate of application of the resin, along with the fiber reinforcement structure, will control the volume of voids within the matrix. The pre-former of the resin may contain fibers 30 prior to its application on the base. An alternative method is to have the fibers 30 on the woven base 20 prior to application of the resin.

Following application, the resin 40 is dried and cured, employing conventional drying and heating apparatus. The temperature of curing will be dependent on the type of resin employed. A wide variety of such resin are known an many are commercially available. Representative resin which may be used are polyurethane for resiliency and cleanability and polyvinyl chloride for hardness and compaction resistance. Flexible coatings may also be formed from mixtures of polymeric resins.

While the woven base 20 shown in FIG. 2 is a single layer, a greater number of layers in the woven base is also possible. Other modifications would be obvious to one skilled in the art without departing from the scope of the invention as defined in the appended claims.

What is claimed is:

1. A method of manufacturing a woven press felt base having at least one woven layer which comprises:

providing a woven base;

coating said woven base with fluid resin containing a network of textile fibers;

curing said resin on said woven felt base; and grinding said resin coated woven felt base to open sealed voids said channels and to impact a smooth, highly uniform finished surface to said felt.

2. A method of manufacturing a woven press felt base having at least one woven layer which comprises:

providing a woven base with a network of textile fibers;

coating said woven base with a fluid resin;

curing said resin on said woven felt base; and grinding said resin coated woven felt base to open sealed void channels and to impart a smooth, highly uniform finished surface to said woven felt base.

* * * * *